US010441017B2

(12) United States Patent
Kim

(10) Patent No.: US 10,441,017 B2
(45) Date of Patent: Oct. 15, 2019

(54) USER HEAD MOUNTED PROTECTION APPARATUS AND METHOD OF OPERATING SAME

(71) Applicant: HUMAX CO., LTD., Yongin (KR)

(72) Inventor: Yong Joo Kim, Yongin-si (KR)

(73) Assignee: HUMAX CO., LTD., Yongin-si (KR)

( * ) Notice: Subject to any disclaimer, the term of this patent is extended or adjusted under 35 U.S.C. 154(b) by 0 days.

(21) Appl. No.: 16/137,711

(22) Filed: Sep. 21, 2018

(65) Prior Publication Data

US 2019/0090571 A1 Mar. 28, 2019

(30) Foreign Application Priority Data

Sep. 25, 2017 (KR) ..... 10-2017-0123187

(51) Int. Cl.

| | |
|---|---|
| ***A42B 3/04*** | (2006.01) |
| ***H04S 7/00*** | (2006.01) |
| ***H04R 5/033*** | (2006.01) |
| ***H04S 1/00*** | (2006.01) |

(52) U.S. Cl.

CPC ..... *A42B 3/046* (2013.01); *H04R 5/033* (2013.01); *H04S 1/005* (2013.01); *H04S 7/304* (2013.01)

(58) Field of Classification Search

CPC ..... H04R 5/033; H04S 7/304; H04S 1/005; A42B 1/245

USPC ..... 381/300, 86

See application file for complete search history.

(56) References Cited

U.S. PATENT DOCUMENTS 6,580,374 B2 * 6/2003 Schrage ..... G08G 1/095 340/905

FOREIGN PATENT DOCUMENTS

| | | | | |
|---|---|---|---|---|
| JP | 2004322771 | A | | 11/2004 |
| JP | 2007127459 | A | | 5/2007 |
| KR | 10-2005-0002288 | A | | 1/2005 |
| KR | 10-2010-0076479 | A | | 7/2010 |
| KR | 10-2012-0071462 | A | | 7/2012 |
| KR | 10-2017-0101731 | A | | 9/2017 |
| KR | 20170101731 | A | * | 9/2017 |

* cited by examiner

*Primary Examiner* — Paul Kim

(57) ABSTRACT

Disclosed is a user head mounted protection apparatus. The user head mounted protection apparatus includes a warning element management device that identifies a warning element by using sensing information generated by sensing a nearby object to generate location information of the warning element, a sensor that detects a rotation of the user head mounted protection apparatus to generate rotation angle information, a corrector that corrects the location information of the warning element by using the rotation angle information, a sound source processor that binaurally renders a sound source by using the location information of the warning element or the corrected location information, and an output device that outputs the binaurally rendered sound source.

14 Claims, 14 Drawing Sheets

USER HEAD MOUNTED PROTECTION APPARATUS AND METHOD OF OPERATING SAME

CROSS-REFERENCE TO RELATED APPLICATION

This application is based on and claims the benefit of priority under 35 U.S.C. 119(a) to Korean Patent Application No. 10-2017-0123187, filed on Sep. 25, 2017, in the Korean Intellectual Property Office, the disclosure of which is incorporated herein in its entirety by reference.

TECHNICAL FIELD

Embodiments of the present disclosure relates to a user head mounted protection apparatus and a method of operating the same, and more particularly, to a user head mounted protection apparatus capable of outputting a sound source to allow a user to recognize a direction in which a warning element exists, and a method of operating the same.

BACKGROUND

As various moving means such as bikes, bicycles, kickboards, and the like are popularized, many people are traveling on roads or walkways using such moving means. In the case of using such a moving means, it is necessary to wear a protective helmet for safety, and in some moving means, it is mandatory to wear a protective helmet by law.

However, such a protective helmet has only a secondary user protection function that relieves a shock when a user collides with a vehicle, an obstacle, a pedestrian, and does not provide a function of predicting an accident in advance to notify or prevent the accident, so that the function is quite limited. In addition, when a user wears a protective helmet, the user's field of view is limited so that the range of observing or predicting various risks/collisions that may occur during travelling is limited.

SUMMARY

An object of the present disclosure is to provide a user head mounted protection apparatus that is capable of outputting a warning sound to allow a user to intuitively recognize a direction in which a risk is expected, and a method of operating the same.

The technical problems to be solved by the present inventive concept are not limited to the aforementioned problems, and any other technical problems not mentioned herein will be clearly understood from the following description by those skilled in the art to which the present disclosure pertains.

To achieve the object, according to one aspect of the present disclosure, there is provided a user head mounted protection apparatus which includes a warning element management device that identifies a warning element by using sensing information generated by sensing a nearby object to generate location information of the warning element, a sensor that detects a rotation of the user head mounted protection apparatus to generate rotation angle information, a corrector that corrects the location information of the warning element by using the rotation angle information, a sound source processor that binaurally renders a sound source by using the location information of the warning element or the corrected location information, and an output device that outputs the binaurally rendered sound source.

The warning element management device may include a movement trajectory calculating device that calculates a movement trajectory of the nearby object by using the sensing information, a warning element identifying device that compares the calculated movement trajectory with a movement trajectory of the user head-mounted protection apparatus to determine a possibility of collision between the nearby object and the user head mounted protection apparatus to identify the nearby object as the warning element based on a determination result, and a location information generating device that generates location information of the identified warning element.

The sensing information may include at least one of image information and radar sensor information.

The user head mounted protection apparatus may further include a vibration generating device that generates a vibration in the user head mounted protection apparatus.

The warning element management device may compare the location information of the warning element with the rotation angle information after the binaurally rendered sound source is output, and controls the vibration generating device based on a comparison result.

The warning element management device may control the vibration generating device to generate a vibration when a difference between a location of the warning element based on the location information of the warning element and a rotation angle of the user head mounted protection apparatus based on the rotation angle information is increased.

The warning element management device may determine whether the user head mounted protection apparatus and the warning element approach each other by using the location information of the warning element, wherein the sound source processor increases a volume of the sound source as the user head mounted protection apparatus and the warning element is closer to each other.

The output device may include a first output module and a second output module.

According to another embodiment, there is provided a user head mounted protection apparatus which includes a warning element management device that identifies a warning element by using sensing information generated by sensing a nearby object to generate location information of the warning element, a sensor that detects a rotation of the user head mounted protection apparatus to generate rotation angle information, a corrector that corrects the location information of the warning element by using the rotation angle information, an output device that outputs a sound source through a plurality of channels, and a sound source processor that time-delays the sound source by using the location information of the warning element or the corrected location information such that the sound source is output with different delay times through the plurality of channels.

The output device may include a third output module, a fourth output module, a fifth output module, and a sixth output module.

The third output module, the fourth output module, the fifth output module, and the sixth output module may output the sound source at different timings, respectively.

The sound source processor may time-delay the sound source such that one among the third to sixth output modules, which is closer to a location of the warning element defined based on the location information of the warning element or the corrected location information, or to a corresponding point on the user head mounted protection apparatus than another, outputs the sound source ahead of the another.

The sound source processor may set volumes of sound sources output to the third to sixth output modules such that a volume of one among the third to sixth output modules, which is closer to a location of the warning element defined based on the location information of the warning element or the corrected location information, or to a corresponding point on the user head mounted protection apparatus than another, is greater than a volume of the another.

According to still another embodiment, there is provided a method of operating a user head mounted protection apparatus, which includes identifying a warning element by using sensing information generated by sensing a nearby object, generating location information of the warning element, sensing a rotation of the user head mounted protection apparatus to generate rotation angle information, correcting the location information of the warning element by using the rotation angle information, time-delaying the sound source by using the location information of the warning element or the corrected location information such that sound sources output through the plurality of channels have different delay times, and outputting the time delayed sound sources.

According to the user head mounted protection apparatus and the method of operating the same according to the embodiments of the present disclosure, the warning sound may be output to allow a user to intuitively recognize a direction in which a risk is expected.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
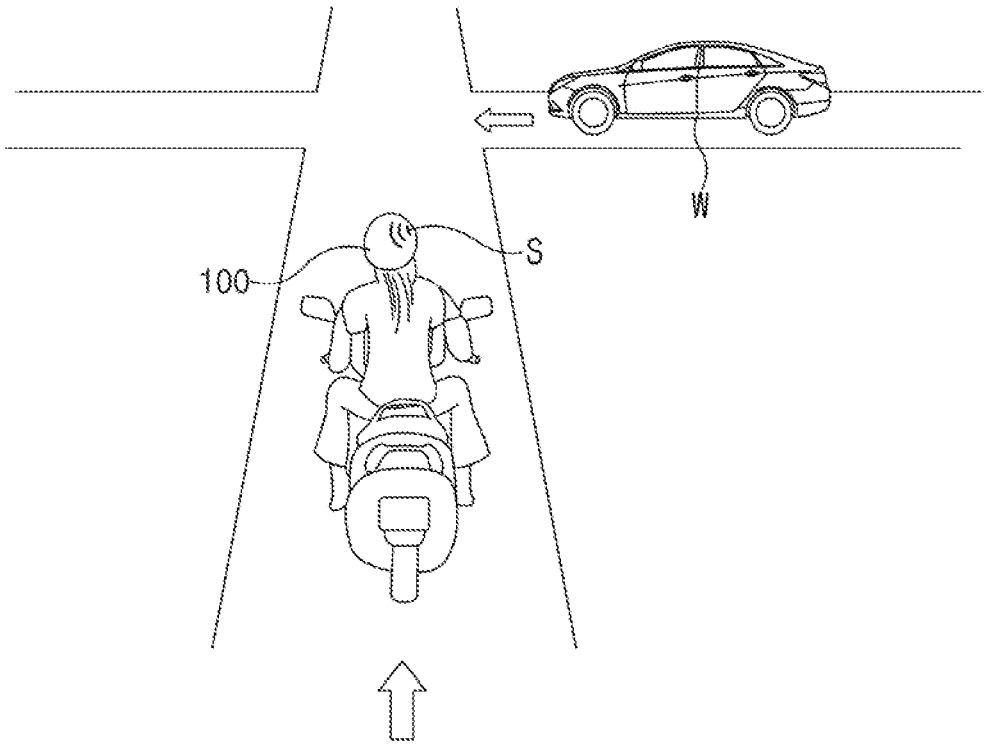
FIG. 1 is a conceptual view illustrating a user head mounted protection apparatus according to an embodiment of the present disclosure.

Hereinafter, exemplary embodiments of the present disclosure will be described in detail with reference to the accompanying drawings. In the drawings, the same reference numerals will be used throughout to designate the same or equivalent elements. In addition, a detailed description of well-known features or functions will be ruled out in order not to unnecessarily obscure the gist of the present disclosure.

In describing the components of the present disclosure, terms like first, second, "A", "B", (a), and (b) may be used. These terms are intended solely to distinguish one component from another, and the terms do not limit the nature, sequence or order of the constituent components. In addition, unless otherwise defined, all terms used herein, including technical or scientific terms, have the same meanings as those generally understood by those skilled in the art to which the present disclosure pertains. Such terms as those defined in a generally used dictionary are to be interpreted as having meanings equal to the contextual meanings in the relevant field of art, and are not to be interpreted as having ideal or excessively formal meanings unless clearly defined as having such in the present application.

FIG. 1 is a conceptual view illustrating a user head mounted protection apparatus according to an embodiment of the present disclosure.

Referring to FIG. 1, a user head mounted protection apparatus 100 may be applied to a user protective helmet to output a warning sound such that the user intuitively recognizes the position and/or direction in which a danger is expected. Hereinafter, for the purpose of facilitating the understanding of the present disclosure, as an example, a case where the user head mounted protection apparatus 100 according to an embodiment of the present disclosure is applied to a protective helmet will be described.

For example, there may occur a case where a collision is expected at a specific point in consideration of a movement trajectory of a moving unit (e.g., a bike) on which a user gets and a movement trajectory of another object (e.g., another vehicle). In this case, the user head mounted protection apparatus 100 may determine another object as a warning element W and may output a warning sound so that the user recognizes the location and/or the direction where the another object is located. The warning sound may be output through a 2-channel speaker or a 4-channel speaker, and the number of speakers is not limited thereto. The sound image S of the three-dimensional warning sound output through the two-channel or four-channel speaker may be formed in a direction corresponding to the position of the warning element W.

Therefore, the user may intuitively recognize the location and/or direction, at which a danger is expected, through the warning sound output from the user head mounted protection apparatus 100, and may avoid a dangerous situation in advance to prevent a traffic accident.

Figure 2:
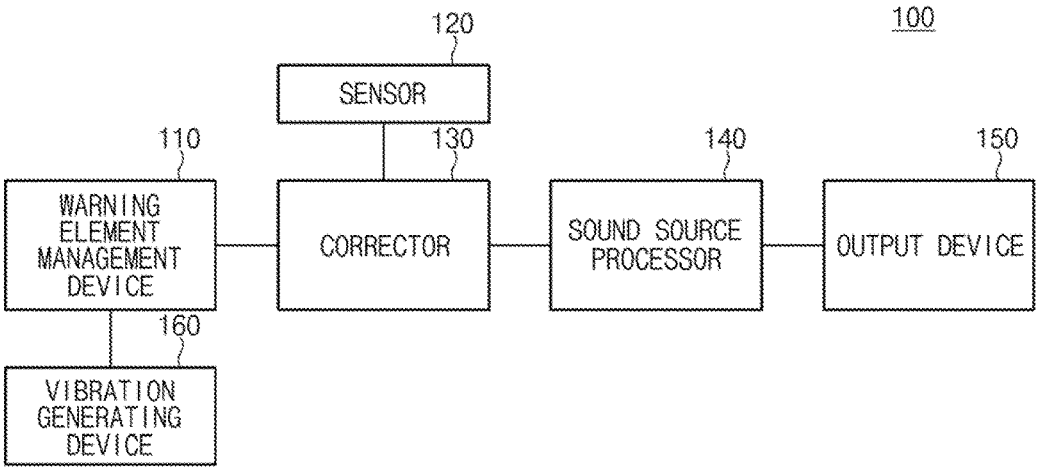
FIG. 2 is a block diagram illustrating a user head mounted protection apparatus according to an embodiment of the present disclosure.
Figure 3:
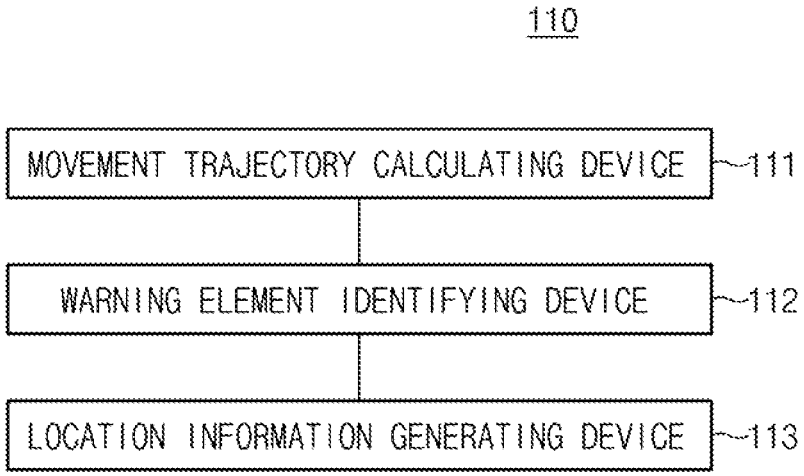
FIG. 3 is a block diagram illustrating a warning element management device of a user head mounted protection apparatus according to an embodiment of the present disclosure.

FIG. 2 is a block diagram illustrating a user head mounted protection apparatus according to an embodiment of the present disclosure. FIG. 3 is a block diagram illustrating a warning element management device of a user head mounted protection apparatus according to an embodiment of the present disclosure.

First, referring to FIG. 2, the user head mounted protection apparatus 100 according to an embodiment of the present disclosure may include a warning element management device 110, a sensor 120, a corrector 130, a sound source processor 140, an output device 150, and a vibration generating device 160.

The warning element management device 110 may identify a warning element by using sensing information generated by sensing a nearby object to generate location information of the identified warning element. Referring to FIG.

3, the warning element management device 110 may include a movement trajectory calculating device 111, a warning element identifying device 112, and a location information generating device 113.

The movement trajectory calculating device 111 may use the sensing information to calculate the movement trajectory of at least one object. For example, the at least one object may include a vehicle, an obstacle, a person, and the like, and the movement trajectory may include a real-time location change of the object.

In addition, the sensing information may be at least one of image information and radar sensor information, and may include information about a moving speed and a location of at least one object. The image information may be received from a camera (a front camera and/or a rear camera) arranged on the user head mounted protection apparatus 100 or from a camera arranged on a moving means of a user. Similarly, the radar sensor information may be received from a radar sensor (a front radar sensor and/or a rear radar sensor) arranged on the user head mounted protection apparatus 100 or a radar sensor arranged on the moving means of the user.

The warning element identifying device 112 may determine whether at least one object is a warning element. In detail, the warning element identifying device 112 may compare the calculated movement trajectory of the at least one object with the movement trajectory of the user head mounted protection apparatus 100 (i.e., the movement trajectory of the moving means on which the user gets) to determine whether a collision is possible, and may identify the at least one object as a warning element when a collision is possible.

To this end, the warning element identifying device 112 may receive the speed and/or location information of the moving means, on which the user gets, from the sensing device (not shown) arranged on the user head mounted protection apparatus 100 or the sensing device arranged on the moving means of the user. However, when at least one sensed object is a fixed object, the warning element identifying device 112 may compare the movement trajectory of the user head mounted protection apparatus 100 with the location information of the object to determine whether the object is a warning element. Meanwhile, the warning element may be defined as a concept that includes an object that is possible to collide with the moving means of the user or an object that has at least one contact point between the movement trajectories even though there is no possibility of collision.

In addition, the warning element identifying device 112 may determine whether the warning element approaches the user head mounted protection apparatus 100, by using the location information of the warning element. For example, the warning element identifying device 112 may compare the calculated movement trajectory of at least one object with the movement trajectory of the user head mounted protection apparatus 100 (i.e., the movement trajectory of the moving means on which the user gets) to determine whether the user head mounted protection apparatus 100 approaches the warning element within a specified distance (e.g., within 1 meter).

The location information generating device 113 may generate location information of at least one object determined as a warning element. The location information generating device 113 may transmit the generated location information of the warning element to the corrector 130 or the sound source processor 140. In this case, the location information may include position values in X, Y, and Z axes in the Cartesian coordinate system and/or r, θ and φ coordinate values in a spherical coordinate system.

However, according to an embodiment, the location information generating device 113 may generate location information of at least one object by using only the X-axis position value and the Y-axis position value. This is because it can be assumed that the moving means on which the user gets and at least one object exists on the same plane. When the location information is generated using only the X-axis position value and the Y-axis position value, a load of the location information generating device 113 may be reduced.

Meanwhile, when at least one object determined as a warning element is a moving object, the location information generating device 113 may transmit the location information of the warning element to the corrector 130 or the sound source processor 140 in real time or every specific time interval.

The sensor 120 may sense the rotation of the user head mounted protection apparatus 100 and may generate rotation angle information. For example, the sensor 120 may include a gyro sensor, and the rotation angle information may include a yaw value according to the rotation of the user head mounted protection apparatus 100. However, the present disclosure is not limited thereto, and according to an embodiment, the rotation angle information may include at least one of yaw, pitch, and roll values. The sensor 120 may transmit the generated rotation angle information to the warning element management device 110 and/or the corrector 130.

The corrector 130 may receive information about whether the rotation of the user head mounted protection apparatus 100 is detected and the rotation angle information from the sensor 120. When the rotation of the user-head mounted protection device 100 is detected, the corrector 130 may correct the location information of the warning element by reflecting the rotation angle information. For example, the corrector 130 may convert the yaw value received from the sensor 120 into the (X, Y) value to correct the location information of the warning element. The corrector 130 may transmit the corrected location information to the sound source processor 140.

The sound source processor 140 may binaurally render the sound source by using the location information of the warning element or the corrected location information, or may time-delay the sound source. This will be described in more detail below. Accordingly, even when the rotation occurs as the user wearing the protective helmet to which the user head mounted protection apparatus 100 is applied turns his or her head, the sound source processor 140 may process the sound source to form a sound image in a direction corresponding exactly to the location of the warning element and output the sound image. Furthermore, the sound source processor 140 may increase the warning effect by increasing the volume of the sound source when the warning element is closed to the user head mounted protection apparatus 100.

The output device 150 may output the sound source transmitted from the sound source processor 140. For example, the output device 150 may be implemented as a two-channel speaker or a four-channel speaker, but the present disclosure is not limited thereto.

The vibration generating device 160 may generate vibration in the user head mounted protection apparatus 100. The vibration generating device 160 may generate vibration in the user head mounted protection apparatus 100 in response to the control of the warning element management device 110. For example, after the sound source is outputted through the output device 150, the warning element management device 110 may compare the location information of the warning element with the rotation angle information of the user head mounted protection apparatus 100, and may control the vibration generating device 160 based on the comparison result.

For example, when the difference between the location information of the warning element and the rotation angle of the user head mounted protection apparatus 100 is not decreased (i.e., when the user hears the three-dimensional sound source and does not turn his or her head toward the warning element), the warning element management device 110 may control the vibration generating device 160 to generate vibration. Therefore, it is possible to enhance the prevention effect of traffic accident by informing the user of the existence of the warning element in a complementary manner.

Figure 4:
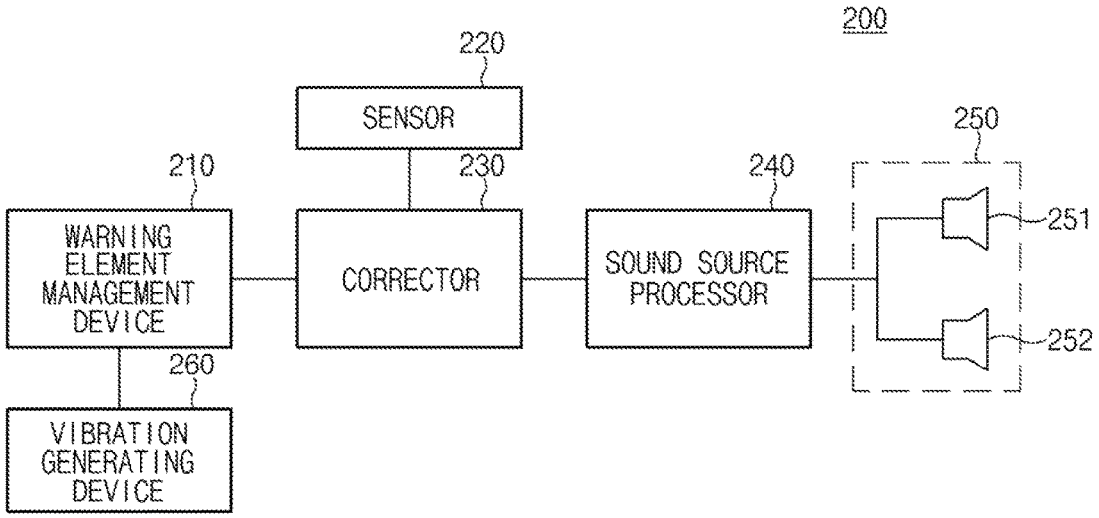
FIGS. 4 and 5 are views illustrating a user head mounted protection apparatus according to another embodiment of the present disclosure.
Figure 5:
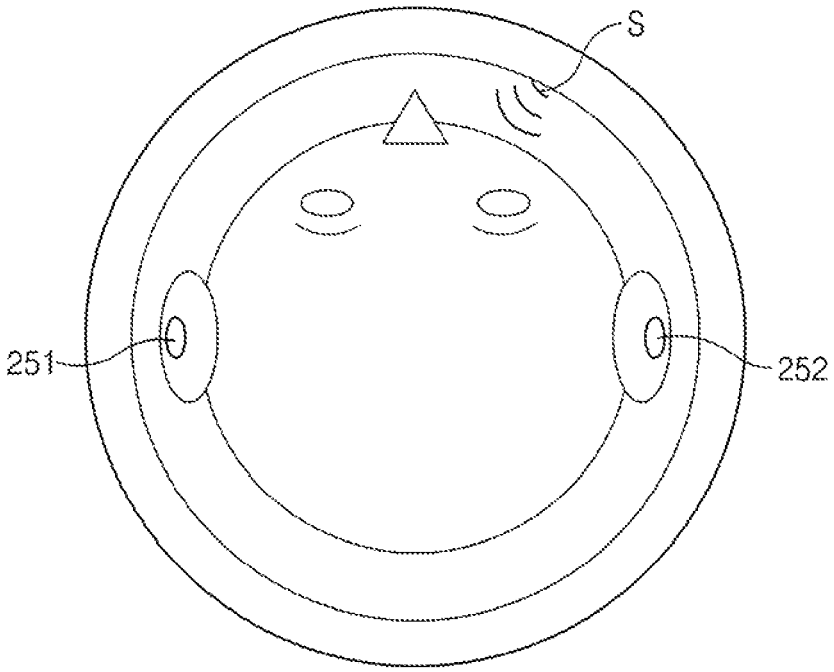

FIGS. 4 and 5 are views illustrating a user head mounted protection apparatus according to another embodiment of the present disclosure.

FIGS. 4 and 5 illustrate an embodiment in which the sound source processor 140 of the user head mounted protection apparatus 100 according to an embodiment of the present disclosure binaurally renders a sound source.

Referring to FIGS. 4 and 5, a user head mounted protection apparatus 200 according to another embodiment of the present disclosure may include a warning element management device 210, a sensor 220, a corrector 230, a sound source processor 240, an output device 250, and a vibration generating device 260. The output device 250 may include first and second output modules 251 and 252.

The operations of the warning element management device 210, the sensor 220, the corrector 230, and the vibration generating device 260 may be substantially the same as those described with reference to FIG. 2. Thus, the following description will be focused on the sound source processor 240 and the output device 250.

The sound source processor 240 may binaurally render the sound source by using the location information of a warning element or the corrected location information. For example, the sound source processor 240 may binaurally render the sound source by using a head related transfer function (HRTF).

For example, the sound source processor 240 may generate a binaural parameter value used for the binaural rendering using the location information of the warning element or the corrected location information. The binaural parameter may mean a parameter value for controlling the binaural rendering, and the binaural parameter may mean a set value of the HRTF according to an embodiment. In this case, the HRTF may be defined as a transfer function of modeling a process of transmitting sound from the sound source at a specific location to both ears of a person.

The sound source processor 240 may transmit the binaurally rendered sound source to the first and second output modules 251 and 252.

The first and second output modules 251 and 252 may output a binaurally rendered sound source. The first and second output modules 251 and 252 may be provided in an earphone or headset type. For example, the first output module 251 may be a left earphone or a left speaker of a headset, and the second output module 252 may be a right earphone or a right speaker of the headset, but the embodiment is not limited thereto.

As described above, since the sound source processor 240 binaurally renders and outputs the sound source through the binaural rendering using the location information of the warning element or the corrected location information such that a sound image is formed in the direction corresponding to the location information of the warning element, the user may listen to the sound source, thereby intuitively recognizing the location and/or direction of the warning element.

Figure 6:
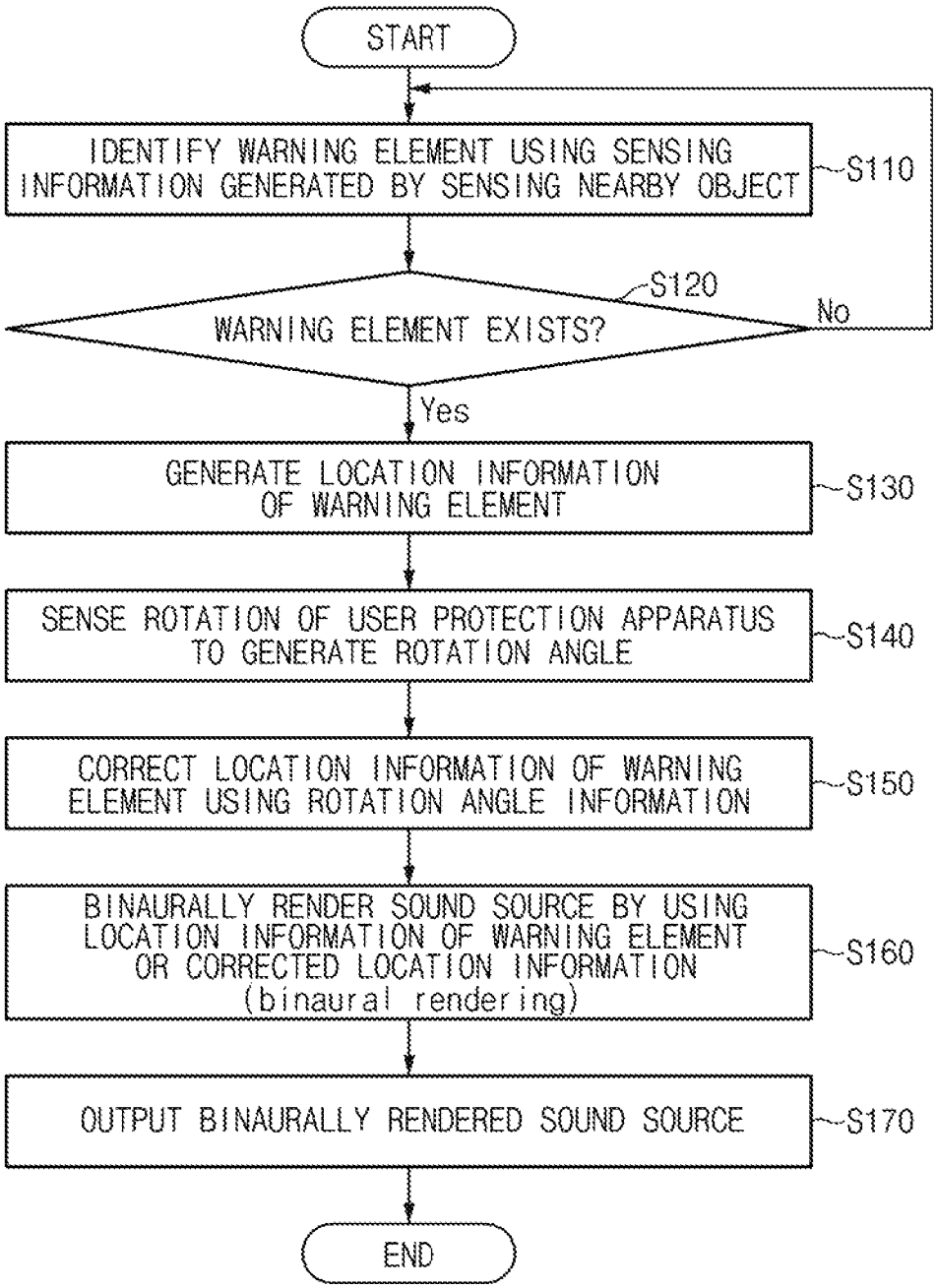
FIG. 6 is a flowchart illustrating a method of operating a user head mounted protection apparatus according to another embodiment of the present disclosure.

FIG. 6 is a flowchart illustrating a method of operating a user head mounted protection apparatus according to another embodiment of the present disclosure.

Referring to FIG. 6, a method of operating a user head mounted protection apparatus according to another embodiment of the present disclosure may include identifying a warning element by using sensing information generated by sensing a nearby object in operation S110, determining whether a warning element exists in operation S120, generating location information of the warning element when the warning element exists in operation S130, sensing a rotation of the user head mounted protection apparatus to generate rotation angle intonation in operation S140, correcting the location information of the warning element by using the rotation angle information in operation S150, binaurally rendering the sound source by using the location information of the warning element or the corrected location information in operation S160, and outputting the binaurally rendered sound source in operation S170.

Hereinafter, the details of operations S110 to S170 described above will be described in detail with reference to FIG. 4. Thus, additional description will be omitted to avoid redundancy.

In operation S110, the warning element management device 210 may use the sensing information generated by sensing the nearby object to identify the warning element. The warning element management device 210 may calculate the movement trajectory of at least one object by using the sensing information, compare the calculated movement trajectory with the movement trajectory of the user head mounted protection apparatus 200 (i.e., the movement trajectory of the moving means on which the user gets) to determine whether a collision is possible, and identify the at least one object as the warning element when a collision is possible.

In operation S120, the warning element management device 210 may determine whether a warning element exists.

In operation S130, the warning element management device 210 may generate the location information of the warning element. In this case, the location information may include position values on X, Y, and Z axes in a Cartesian coordinate system and/or r, θ and φ coordinate values in a spherical coordinate system.

In operation S140, the sensor 220 may sense the rotation of the user head mounted protection apparatus 200 and may generate rotation angle information.

In operation S150, the corrector 230 may correct the location information of the warning element by using the rotation angle information.

In operation S160, the sound source processor 140 may binaurally render the sound source by using the location information of the warning element or the corrected location information.

In operation S170, the output device 250 may output the sound source transmitted from the sound source processor 240.

FIGS. 7 to 11 are views illustrating a user head mounted protection apparatus according to still another embodiment of the present disclosure.

Figure 7:
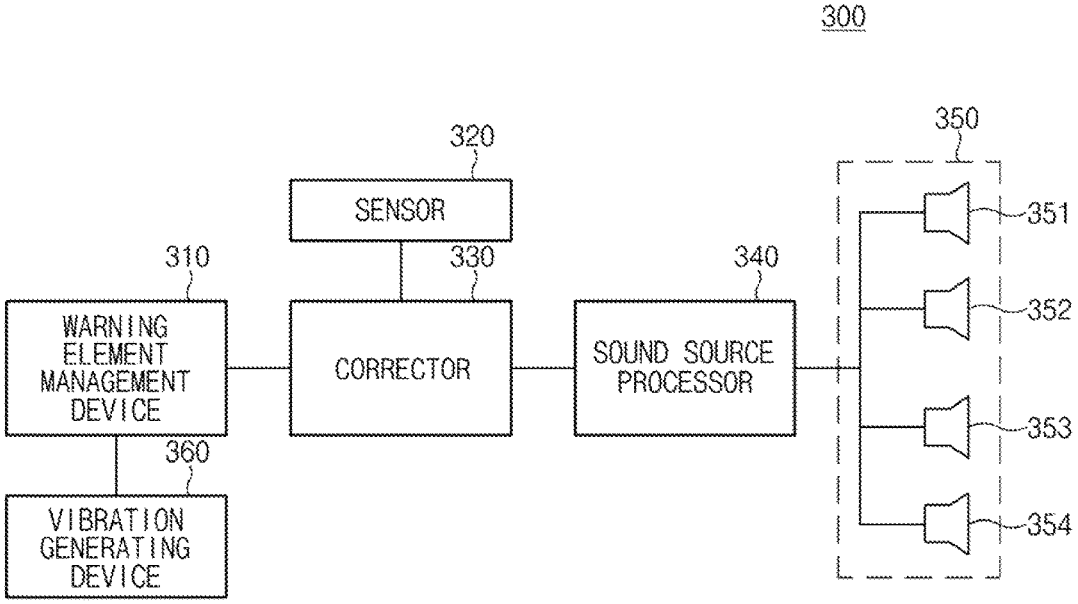
FIGS. 7 to 11 are views illustrating a user head mounted protection apparatus according to still another embodiment of the present disclosure.

FIG. 7 illustrate an embodiment in which a sound source processor 340 of a user head mounted protection apparatus 300 time-delays the sound source such that the sound sources output to channels having different delay times for each channel.

Referring to FIG. 7, the user head mounted protection apparatus 300 according to still another embodiment of the present disclosure may include a warning element management device 310, a sensor 320, a corrector 330, the sound source processor 340, an output device 350, and a vibration generating device 360. The output device 350 may include third to sixth output modules 351 to 354.

The operations of the warning element management device 310, the sensor 320, the corrector 330, and the vibration generating device 360 may be substantially the same as those described with reference to FIG. 2. Thus, the following description will be focused on the sound source processor 240 and the output device 250.

The sound source processor 340 may time-delay the sound source by using the location information of the warning element or the corrected location information such that the sound sources output though channels having different delay times. In this case, the channels may mean the output modules 351 to 354 of the output device 350. For example, the sound source processor 340 may time-delay the sound sources to be output to the third to sixth output modules 351 to 354 based on distances from the location of the warning element defined based on the location information of the warning element or the corrected location information, or a corresponding point on the user head mounted protection apparatus 300, respectively. In this case, the corresponding point on the user head mounted protection apparatus 300 may mean a contact point defined on a straight line and a main body of the user head mounted protection apparatus 300 where the straight line connects the central point of the user head mounted protection apparatus 300 with the location of the warning element. The corresponding point may be defined by the warning element management device 310.

In this case, the sound source may be a beep sound source generated every specified time interval (e.g., 1 second). The sound source processor 340 may transmit the time delayed sound source to the third to sixth output modules 351 to 354.

In addition, the sound source processor 340 may process the sound source by using the location information of the warning element or the corrected location information such that the sound sources are output at different volumes for each channel. For example, the sound source processor 340 may control the volumes of the sound sources to be output to the third to sixth output modules 351 to 354 based on the distances from the location of the warning element defined based on the location information of the warning element or the corrected location information, or the corresponding point on the user head mounted protection apparatus 300. In this case, an amplitude of the sound source may be adjusted (see FIG. 9).

For example, the sound source processor 340 may control the volumes of the sound sources such that the volume of the sound source output to one among the output modules 351 to 354, of which the distance from the location of the warning element defined based on the location information of the warning element or the corrected location information, or from the corresponding point on the user head mounted protection apparatus 300 is shorter than that of another output module, is higher than that of the sound source output to the another output module. Thus, the user may more effectively recognize the direction in which the warning element is located.

The third to sixth output modules 351 to 354 may output the time-delayed sound sources. The third to sixth output modules 351 to 354 may be arranged in the protective helmet to which the user head mounted protection apparatus 300 is applied.

For example, based on a case where the user wears the protective helmet, the third output module 351 may be defined as a speaker arranged at a right side inside the protective helmet, the fourth output module 352 may be defined as a speaker arranged in front inside the protective helmet, the fifth output module 353 may be defined as a speaker arranged at a left side inside the protective helmet, and the sixth output module 354 may be defined as a speaker arranged in the rear inside the protective helmet. However, the arrangement of each output module is not limited to the above.

Figure 8:
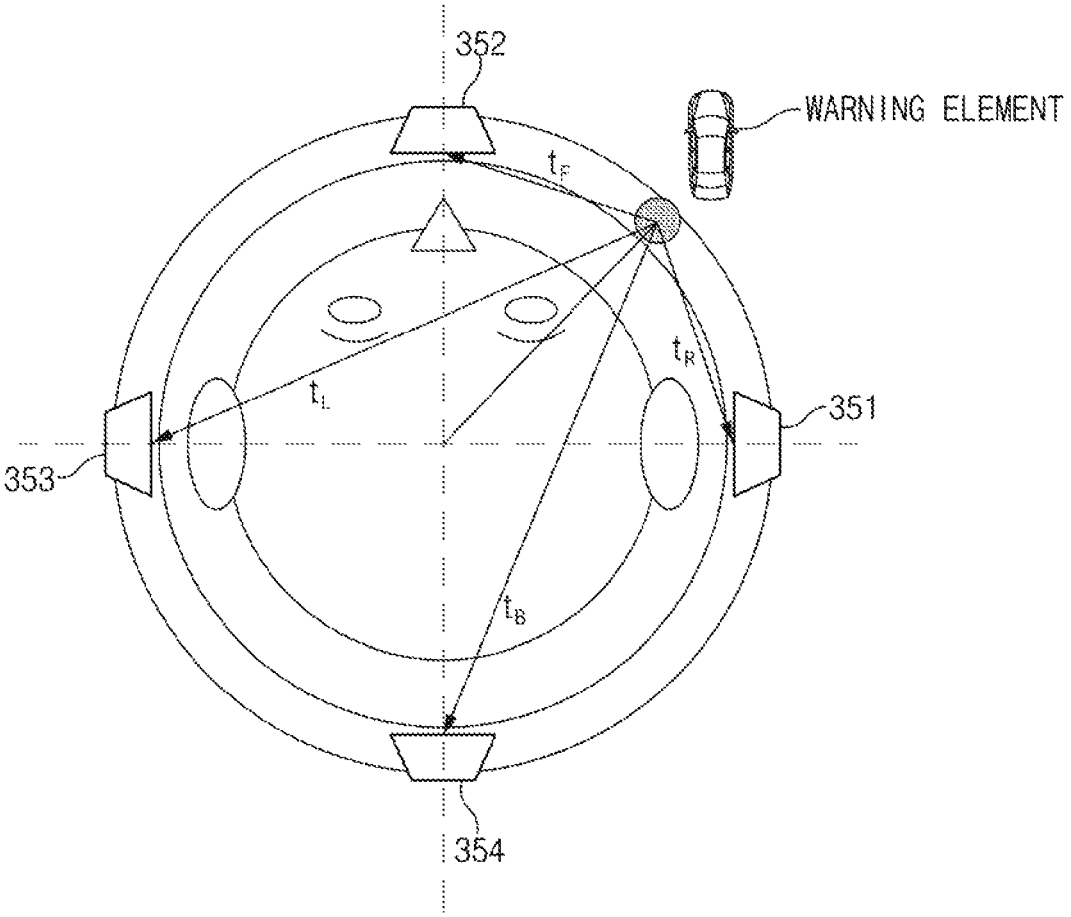
Figure 9:
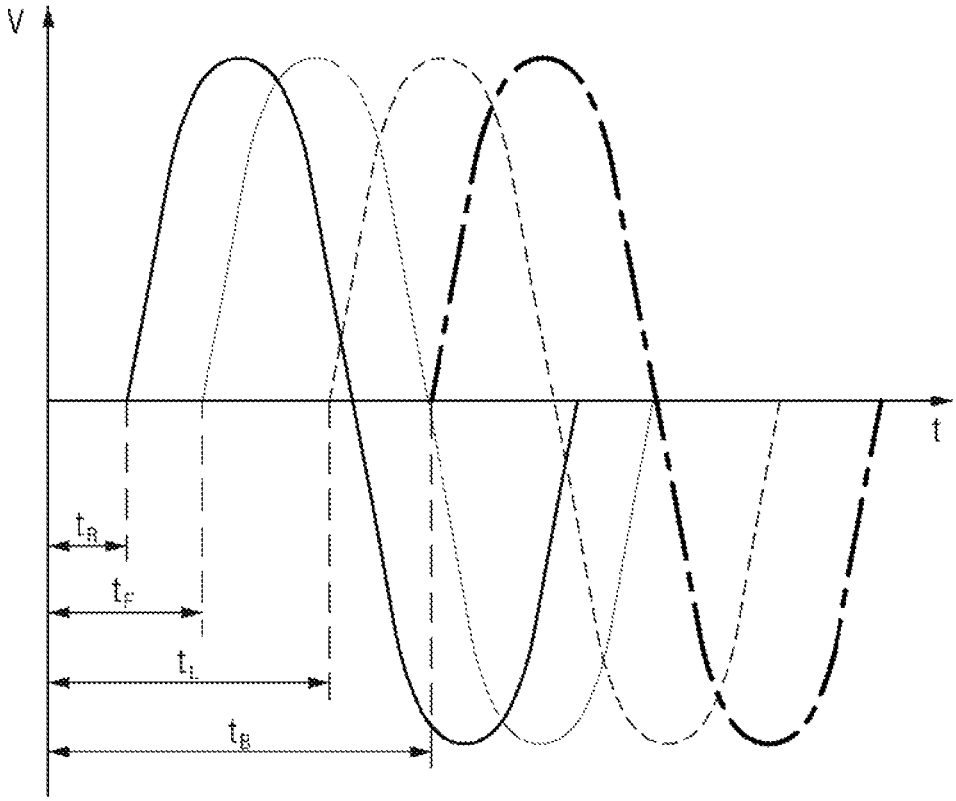

Referring to FIGS. 8 and 9, the sound source processor 340 may delay the sound source by using the location information of the warning element such that the sound source is output to the third to sixth output modules 351 to 354 at different timings.

For example, the sound source processor 340 may delay the sound source such that the output module, which is closer to the location of the warning element defined based on the location information of the warning element or the corrected location information, or to the corresponding point on the user head mounted protection apparatus 300, has a smaller delay time. For example, in FIGS. 8 and 9, the delay time $t_R$ of the sound source output to the third output module 351 may be smaller than the delay time $t_F$ of the sound source output to the fourth output module 352, the delay time $t_F$ of the sound source output to the fourth output module 352 may be smaller than the delay time $t_L$ of the sound source output to the fifth output module 353, and the delay time $t_L$ of the sound source output to the fifth output module 353 may be smaller than the delay time $t_B$ of the sound source output to the sixth output module 354. In this case, the difference $\Delta t$ (the difference between the times when the sound source is output to the output modules such as $|t_R-t_F|$, $|t_F-t_L|$, or $|t_L-t_B|$) between the delay times of the output modules 351 to 354 may be set in the range of 0.6 ms or less which is the maximum value of interaural level difference (ILD), taking into consideration the difference in time of reaching both ears of a person.

By the above-described process, the third output module 351 may output the sound source at a timing earlier than the fourth output module 352, the fourth output module 352 may output the sound source at a timing earlier than the fifth output module 353, and the fifth output module 353 may output the sound source at a timing earlier than the sixth output module 354. Accordingly, the user may intuitively recognize the generation and the location/direction of the warning element through the output of the time-delayed sound source.

In addition, the sound source processor 340 may control the volumes of the sound sources such that the volume of the sound source output to one among the output modules 351 to 354, of which the distance from the location of the warning element defined based on the location information of the warning element or the corrected location information, or from the corresponding point on the user head mounted protection apparatus 300 is shorter than that of another output module, is higher than that of the sound source output to the another output module. For example, the volume of the sound source output to the third output module 351 may be greater than that of the sound source output to the fourth output module 352, the volume of the sound source output to the fourth output module 352 may be greater than that of the sound source output to the fifth output module 353, and the volume of the sound source output to the fifth output module 353 may be greater than that of the sound source output to the sixth output module 354.

Referring again to FIG. 7, the sound source processor 340 may time-delay the sound source by using the corrected location information.

Figure 10:
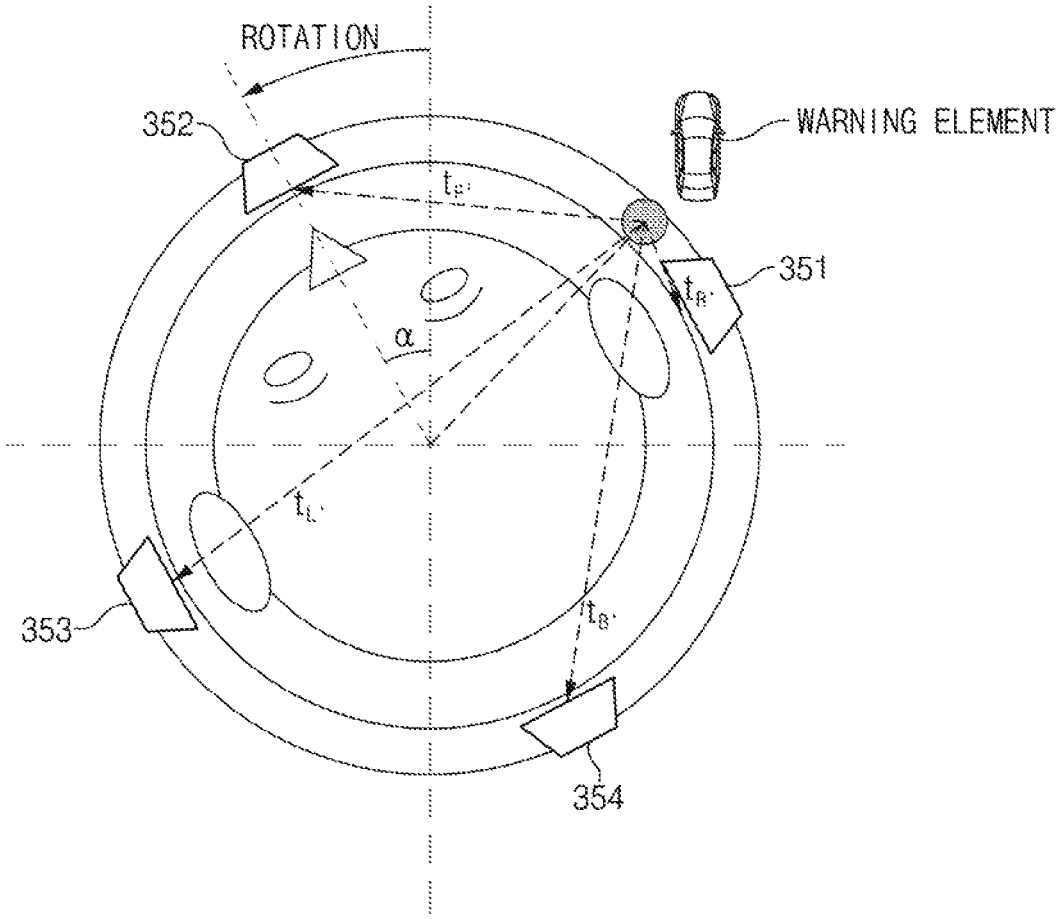
Figure 11:
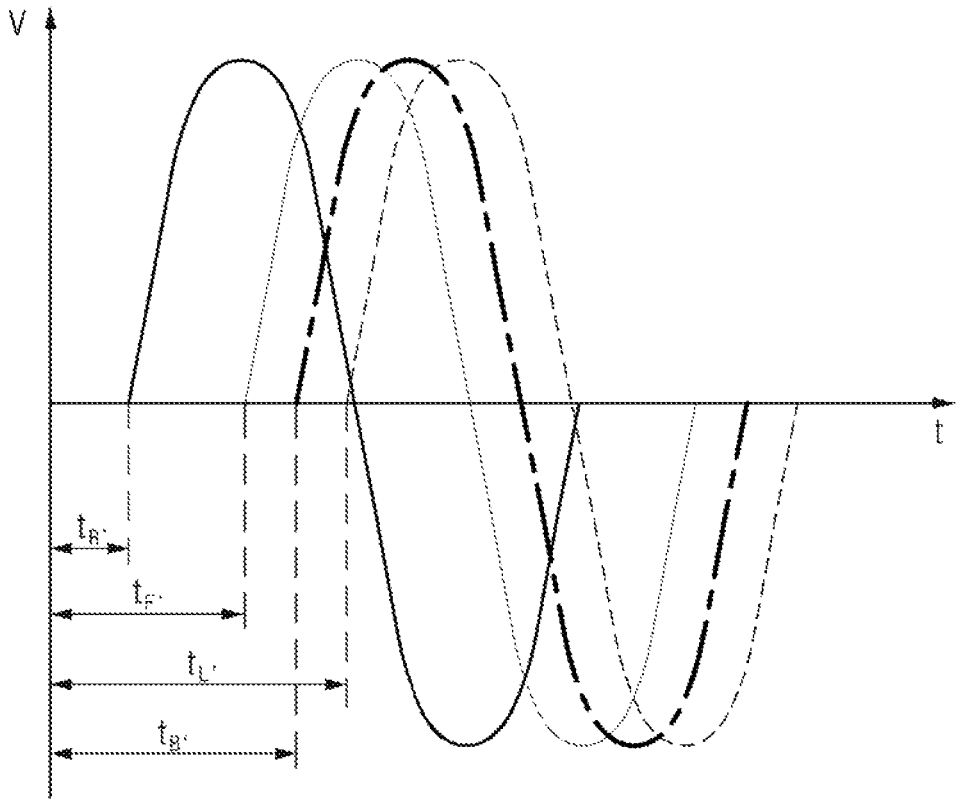

Referring to FIGS. 10 and 11, when the user head mounted protection apparatus 300 is rotated, the sound source processor 340 may delay the sound source by using the corrected location information on which the rotation angle $\alpha$ is reflected such that the output module, which is closer to the location of the warning element defined based on the location information of the warning element or to the corresponding point on the user head mounted protection apparatus 300, has a smaller delay time. For example, as compared with FIG. 8, in FIG. 10, the delay time $t_{R'}$ of the sound source output to the third output module 351 may be further reduced, the delay time $t_{F'}$ of the sound source output to the fourth output module 352 may be further increased, and the delay time $t_{B'}$ of the sound source output to the sixth output module 354 may be smaller than the delay time $t_{L'}$ of the sound source output to the fifth output module 353.

That is, the delay time of the sound source output to the third output module 351 may be changed from $t_R$ to $t_{R'}$, the delay time of the sound source output to the fourth output module 352 may be changed from $t_F$ to $t_{F'}$, the delay time of the sound source output to the fifth output module 353 may be changed from $t_L$ to $t_L$ , and the delay time of the sound source output to the sixth output module 354 may be advanced or delayed from $t_B$ to $t_{B'}$. In this case, the difference $\Delta t$ (the difference between the times when the sound source is output to the output modules such as $|t_{R'}-t_{F'}|$, $|t_{F'}-t_{B'}|$ or $|t_{B'}-t_{L'}|$) between the delay times of the output modules 351 to 354 may be set in the range of 0.6 ms or less which is the maximum value of ILD, taking into consideration the difference in time of reaching both ears of a person.

By the above-described process, compared with the case of FIG. 8, the third output module 351 may output the sound source at a further advanced timing, the fourth output module 352 may output the sound source at a further delayed timing, and the sixth output module 354 may output the sound source at a timing earlier than the fifth output module 353.

Accordingly, the user head mounted protection apparatus 300 may allow the user to intuitively recognize the occurrence and location/direction of the warning element even when the user turns his or her head.

Figure 12:
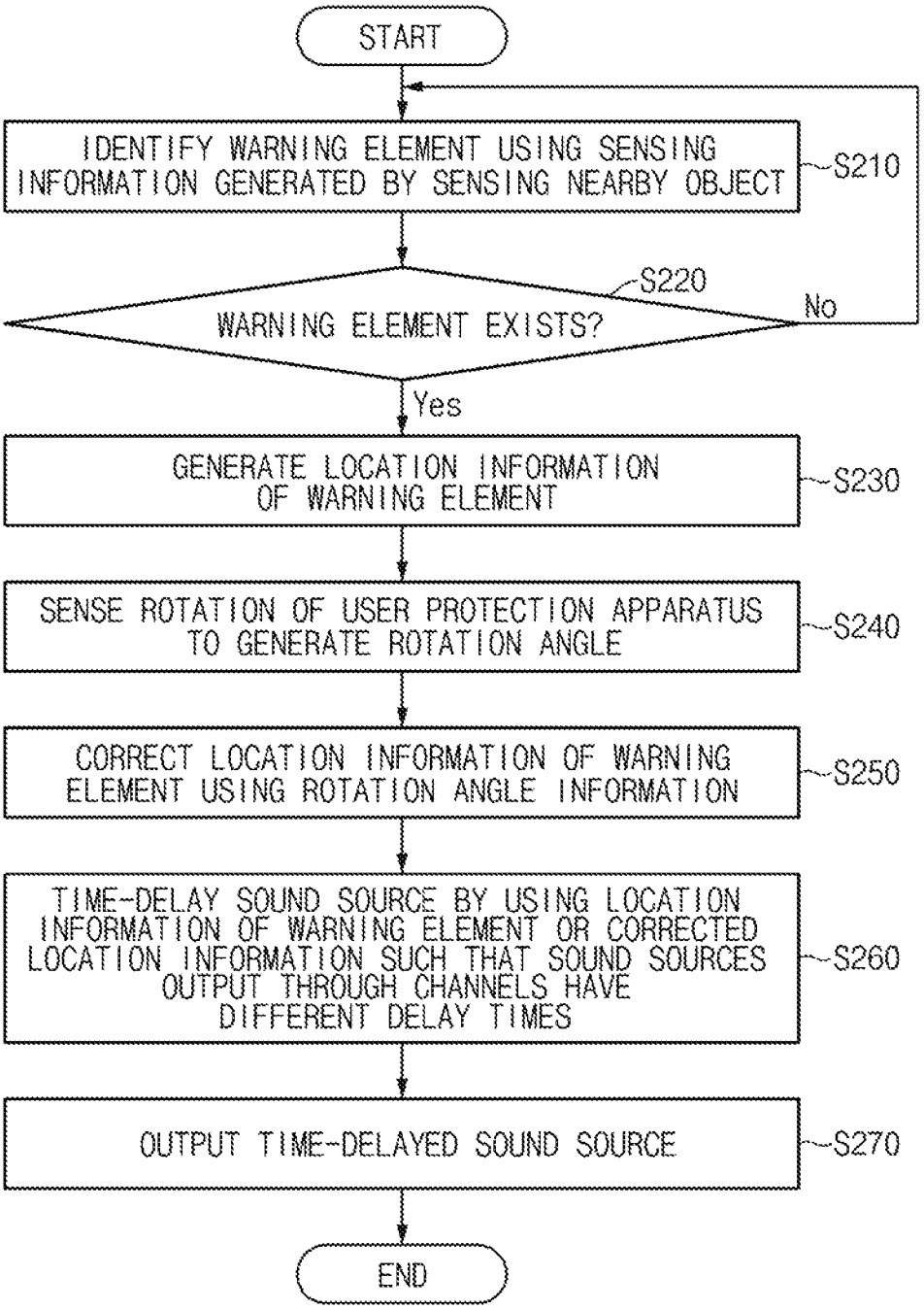
FIG. 12 is a flowchart illustrating a method of operating a user head mounted protection apparatus according to still another embodiment of the present disclosure.

FIG. 12 is a flowchart illustrating a method of operating a user head mounted protection apparatus according to still another embodiment of the present disclosure.

Referring to FIG. 12, a method of operating a user head mounted protection apparatus according to still another embodiment of the present disclosure may include identifying a warning element by using sensing information generated by sensing a nearby object in operation S210, determining whether a warning element exists in operation S220, generating location information of the warning element when the warning element exists in operation S230, sensing a rotation of the user head mounted protection apparatus to generate rotation angle information in operation S240, correcting the location information of the warning element by using the rotation angle information in operation S250, time-delaying the sound source by using the location information of the warning element or the corrected location information such that the sound sources output though channels have different delay times in operation S260, and outputting the time delayed sound sources in operation S270.

Hereinafter, the details of operations S210 to S270 described above will be described with reference to FIG. 7. Thus, additional description will be omitted to avoid redundancy.

In operation S210, the warning element management device 310 may use the sensing information generated by sensing the nearby object to identify the warning element. The warning element management device 310 may calculate the movement trajectory of at least one object by using the sensing information, compare the calculated movement trajectory with the movement trajectory of the user head mounted protection apparatus 300 (i.e., the movement trajectory of the moving means on which the user gets) to determine whether a collision is possible, and identify the at least one object as the warning element when a collision is possible.

In operation S220, the warning element management device 310 may determine whether a warning element exists.

In operation S230, the warning element management device 310 may generate the location information of the warning element. In this case, the location information may include position values on X, Y, and Z-axes in a Cartesian coordinate system and/or r, $\theta$ and $\varphi$ coordinate values in a spherical coordinate system.

In operation S240, the sensor 320 may sense the rotation of the user head mounted protection apparatus 300 and may generate rotation angle information.

In operation S250, the corrector 330 may correct the location information of the warning element by using the rotation angle information.

In operation 260, the sound source processor 340 may time-delay the sound source by using the location information of the warning element or the corrected location information such that the sound sources output though channels have different delay times.

In operation 270, the output device 350 may output the sound source transmitted from the sound source processor 340.

Figure 13:
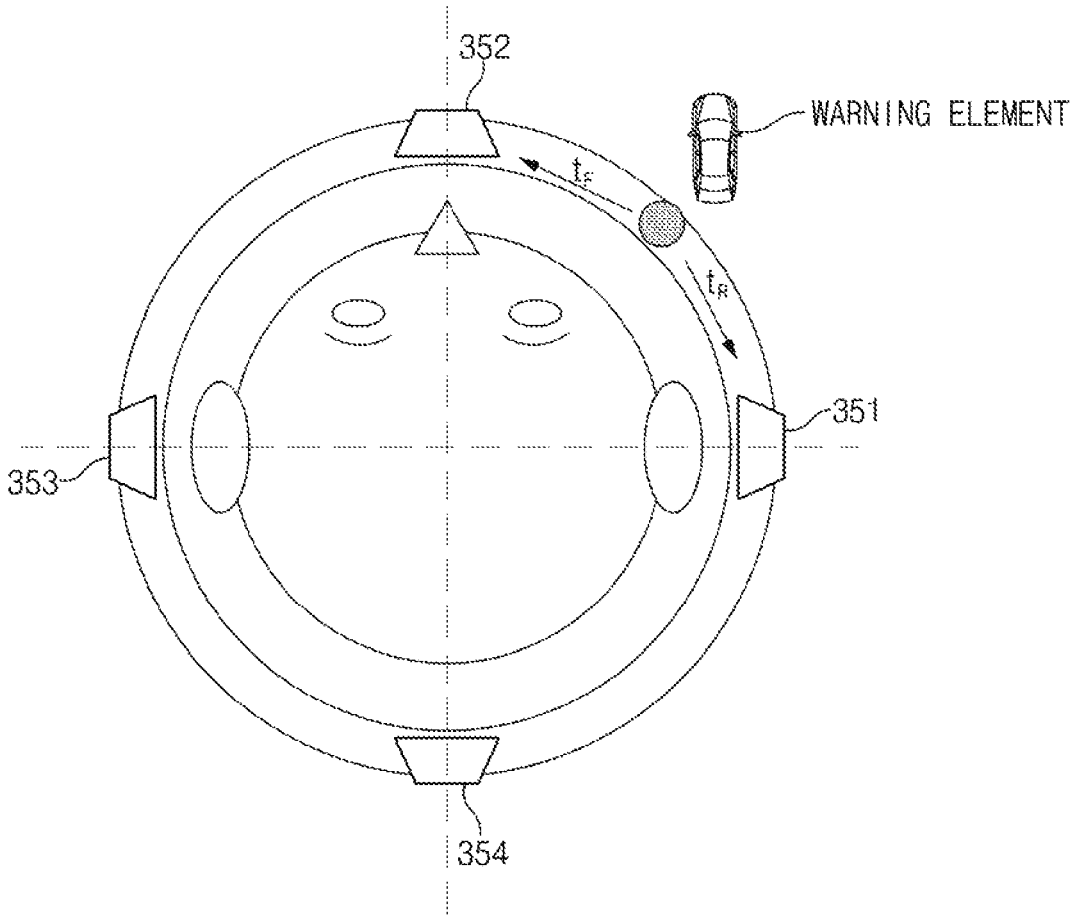
FIGS. 13 and 14 are views illustrating a user head mounted protection apparatus according to still another embodiment of the present disclosure.
Figure 14:
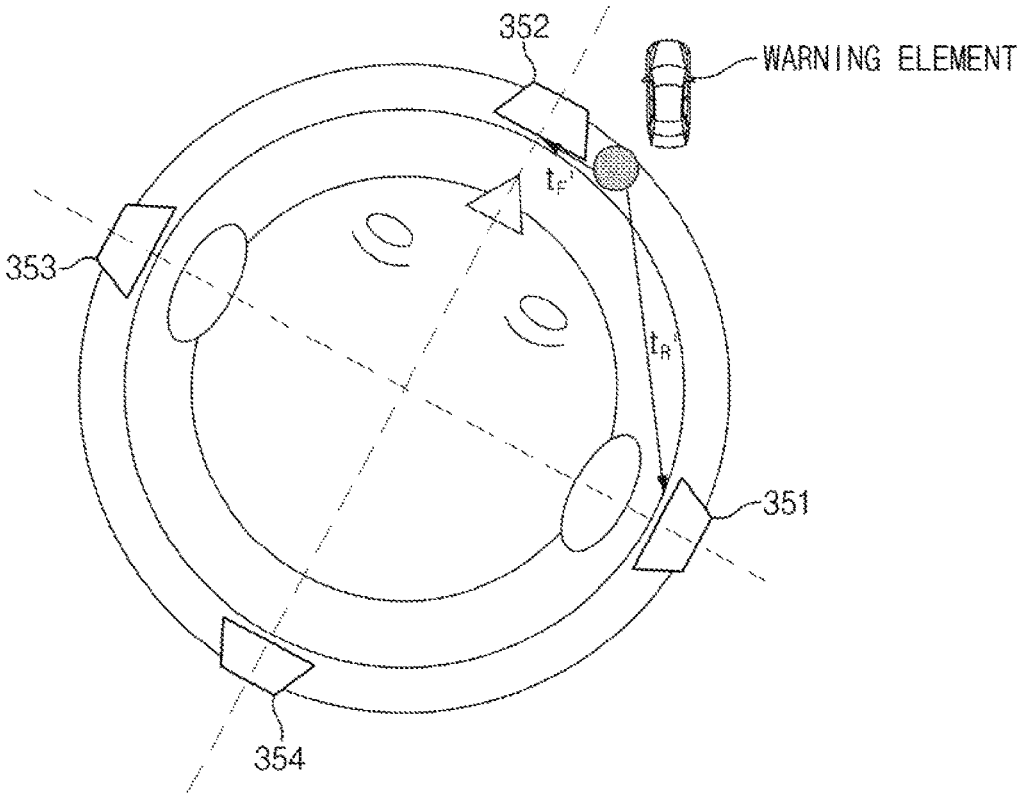

FIGS. 13 and 14 are views illustrating a user head mounted protection apparatus according to still another embodiment of the present disclosure.

As compared with the embodiment described with reference to FIGS. 7 to 11, FIGS. 13 and 14 may be understood as an embodiment in which two output modules closer to the location defined based on the location information of the warning element among four output modules are used.

First, referring to FIG. 13, the sound source processor 340 may time-delay the sound source based on the location information of the warning element. The sound source processor 340 may transmit the time-delayed sound sources to the third and fourth output modules 351 and 352.

For example, the sound source processor 340 may delay the sound source such that the output module, which is closer to the location of the warning element defined based on the location information of the warning element or to the corresponding point on the user head mounted protection apparatus 300, has a smaller delay time. For example, in FIG. 13, the delay time $t_F$ output from the fourth output module 352 may be smaller than the delay time $t_R$ of the sound source output from the third output module 351.

By the above-described process, the fourth output module 352 may output the sound source at a timing earlier than the third output module 351. Accordingly, the user may intuitively recognize the generation and the location/direction of the warning element through the output of the sound source described above.

Referring to FIG. 14, the sound source processor 340 may time-delay the sound source by using the corrected location information on which the rotation angle information is reflected.

For example, the sound source processor 340 may delay the sound source such that the output module, which is closer to the location of the warning element defined based on the location information of the warning element or to the corresponding point on the user head mounted protection apparatus 300, has a smaller delay time. For example, as compared with FIG. 13, in FIG. 14, the delay time $t_{F'}$ of the sound source output to the fourth output module 352 may be further reduced, and the delay time $t_{R'}$, of the sound source output to the third output module 351 may be further increased.

By the above-described process, compared with the case of FIG. 13, the fourth output module 352 may output the sound source at a further advanced timing, and the third output module 351 may output the sound source at a further delayed timing.

Accordingly, the user head mounted protection apparatus 300 may allow the user to intuitively recognize the occurrence and location/direction of the warning element through the output of the time-delayed sound sources even when the user turns his or her head.

Although exemplary embodiments of the present disclosure have been described for illustrative purposes, those skilled in the art will appreciate that various modifications, additions and substitutions are possible, without departing from the scope and spirit of the disclosure.

Therefore, the exemplary embodiments disclosed in the present disclosure are provided for the sake of descriptions, not limiting the technical concepts of the present disclosure, and it should be understood that such exemplary embodiments are not intended to limit the scope of the technical concepts of the present disclosure. The protection scope of the present disclosure should be understood by the claims below, and all the technical concepts within the equivalent scopes should be interpreted to be within the scope of the right of the present disclosure.

What is claimed is:

1. A user head mounted protection apparatus comprising:

a warning element management device configured to identify a warning element by using sensing information generated by sensing a nearby object to generate location information of the warning element;

a sensor configured to detect a rotation of the user head mounted protection apparatus to generate rotation angle information;

a corrector configured to correct the location information of the warning element by using the rotation angle information;

a sound source processor configured to binaurally render a sound source by using the location information of the warning element or the corrected location information; and an output device configured to output the binaurally rendered sound source.

2. The user head mounted protection apparatus of claim 1, wherein the warning element management device includes:

a movement trajectory calculating device configured to calculate a movement trajectory of the nearby object by using the sensing information;

a warning element identifying device configured to compare the calculated movement trajectory with a movement trajectory of the user head mounted protection apparatus to determine a possibility of collision between the nearby object and the user head mounted protection apparatus to identify the nearby object as the warning element based on a determination result; and a location information generating device configured to generate location information of the identified warning element.

3. The user head mounted protection apparatus of claim 1, wherein the sensing information includes at least one of image information and radar sensor information.

4. The user head mounted protection apparatus of claim 1, further comprising:

a vibration generating device configured to generate a vibration in the user head mounted protection apparatus.

5. The user head mounted protection apparatus of claim 4, wherein the warning element management device compares the location information of the warning element with the rotation angle information after the binaurally rendered sound source is output, and controls the vibration generating device based on a comparison result.

6. The user head mounted protection apparatus of claim 5, wherein the warning element management device controls the vibration generating device to generate a vibration when a difference between a location of the warning element based on the location information of the warning element and a rotation angle of the user head mounted protection apparatus based on the rotation angle information is increased.

7. The user head mounted protection apparatus of claim 1, wherein the warning element management device determines whether the user head mounted protection apparatus and the warning element approach each other by using the location information of the warning element, and wherein the sound source processor increases a volume of the sound source as the user head mounted protection apparatus and the warning element is closer to each other.

8. The user head mounted protection apparatus of claim 1, wherein the output device includes a first output module and a second output module.

9. A user head mounted protection apparatus comprising:

a warning element management device configured to identify a warning element by using sensing information generated by sensing a nearby object to generate location information of the warning element;

a sensor configured to detect a rotation of the user head mounted protection apparatus to generate rotation angle information;

a corrector configured to correct the location information of the warning element by using the rotation angle information;

an output device configured to output a sound source through a plurality of channels; and a sound source processor configured to time delay the sound source by using the location information of the warning element or the corrected location information such that the sound source is output with different delay times through the plurality of channels.

10. The user head mounted protection apparatus of claim 9, wherein the output device includes a third output module, a fourth output module, a fifth output module, and a sixth output module.

11. The user head mounted protection apparatus of claim 10, wherein the third output module, the fourth output module, the fifth output module, and the sixth output module output the sound source at different timings, respectively.

12. The user head mounted protection apparatus of claim 10, wherein the sound source processor time-delays the sound source such that one among the third to sixth output modules, which is closer to a location of the warning element defined based on the location information of the warning element or the corrected location information, or to a corresponding point on the user head mounted protection apparatus than another, outputs the sound source ahead of the another.

13. The user head mounted protection apparatus of claim 10, wherein the sound source processor sets volumes of sound sources output to the third to sixth output modules such that a volume of one among the third to sixth output modules, which is closer to a location of the warning element defined based on the location information of the warning element or the corrected location information, or to a corresponding point on the user head mounted protection apparatus than another, is greater than a volume of the another.

14. A method of operating a user head mounted protection apparatus, the method comprising:

identifying a warning element by using sensing information generated by sensing a nearby object;

generating location information of the warning element;

sensing a rotation of the user head mounted protection apparatus to generate rotation angle information;

correcting the location information of the warning element by using the rotation angle information;

time-delaying a sound source by using the location information of the warning element or the corrected location information such that sound sources output through the plurality of channels have different delay times; and outputting the time delayed sound sources.

* * * * *